US010570714B2

(12) United States Patent
Whitson

(10) Patent No.: US 10,570,714 B2
(45) Date of Patent: Feb. 25, 2020

(54) SYSTEM AND METHOD FOR ENHANCED OIL RECOVERY

(71) Applicant: CHW AS, Trondheim (NO)

(72) Inventor: Curtis Hays Whitson, Trondheim (NO)

(73) Assignee: CHW AS, Trondheim (NO)

( * ) Notice: Subject to any disclaimer, the term of this patent is extended or adjusted under 35 U.S.C. 154(b) by 408 days.

(21) Appl. No.: 15/374,514

(22) Filed: Dec. 9, 2016

(65) Prior Publication Data

US 2018/0003017 A1 Jan. 4, 2018

(30) Foreign Application Priority Data

Jun. 29, 2016 (NO) ..... 20161078

(51) Int. Cl.
*E21B 43/16* (2006.01)
*E21B 33/12* (2006.01)
*E21B 34/10* (2006.01)

(52) U.S. Cl.
CPC ..... *E21B 43/16* (2013.01); *E21B 33/12* (2013.01); *E21B 34/10* (2013.01)

(58) Field of Classification Search
CPC ..... E21B 33/12; E21B 34/10; E21B 43/16; E21B 43/162
See application file for complete search history.

(56) References Cited

U.S. PATENT DOCUMENTS 5,377,756 A 1/1995 Northrop et al.
7,147,057 B2 12/2006 Steele
7,367,399 B2 6/2008 Steele
9,127,544 B2 9/2015 Dombrowski
9,187,994 B2 11/2015 Themig
9,328,595 B2 5/2016 Kjoerholt
(Continued)

FOREIGN PATENT DOCUMENTS

CA 2920201 A1 6/2016
GB 2 311 312 A 9/1997
(Continued)

OTHER PUBLICATIONS

Norwegian Search Report dated Dec. 6, 2016 in related NO Application 20161078.

(Continued)

*Primary Examiner* — James G Sayre
(74) *Attorney, Agent, or Firm* — Hershkovitz & Associates, PLLC; Abe Hershkovitz

(57) ABSTRACT

A system and method for enhanced oil recovery comprises a vertical and/or lateral string section configured for installation in a wellbore. A production segment with an uphole production packer and a production valve allows a fluid flow into the string section and prevents a fluid flow in the reverse direction. An injection segment with an uphole injection packer and an injection valve allows a fluid flow out from the string section and prevents a fluid flow in the reverse direction. The production segment and the injection segment are configured to be installed in fluid communication with each other through a reservoir within one well. The production valve is configured to open when the pressure within the production segment is at or below an ambient pressure and to close when the pressure within the production segment exceeds the ambient pressure.

14 Claims, 3 Drawing Sheets

(56) References Cited

U.S. PATENT DOCUMENTS

| | | | | |
|---|---|---|---|---|
| 2003/0066652 | A1* | 4/2003 | Stegemeier | E21B 43/12 166/373 |
| 2005/0072567 | A1 | 4/2005 | Steele | |
| 2007/0017677 | A1 | 1/2007 | Steele | |
| 2008/0017372 | A1* | 1/2008 | Gates | E21B 43/16 166/254.1 |
| 2010/0096128 | A1* | 4/2010 | Hinkel | E21B 43/16 166/270.1 |
| 2010/0276146 | A1* | 11/2010 | Smith | E21B 43/16 166/302 |
| 2011/0048707 | A1* | 3/2011 | Kalman | E21B 43/12 166/279 |
| 2012/0043081 | A1 | 2/2012 | Kjoerholt | |
| 2013/0168099 | A1 | 7/2013 | Themig | |
| 2013/0228337 | A1 | 9/2013 | Dombrowski et al. | |
| 2014/0054050 | A1 | 2/2014 | Lindsay | |
| 2014/0090851 | A1 | 4/2014 | Tips et al. | |
| 2015/0007988 | A1 | 1/2015 | Ayasse | |
| 2015/0007996 | A1 | 1/2015 | Ayasse | |
| 2015/0369023 | A1* | 12/2015 | MacPhail | E21B 43/12 166/269 |
| 2016/0003017 | A1* | 1/2016 | Keller | E21B 43/162 166/250.1 |
| 2016/0047179 | A1 | 2/2016 | Kjorholt et al. | |
| 2016/0298424 | A1 | 10/2016 | Themig | |
| 2017/0226834 | A1* | 8/2017 | Ayasse | E21B 43/20 |
| 2018/0163510 | A1* | 6/2018 | Cleven | E21B 34/063 |

FOREIGN PATENT DOCUMENTS

| | | | |
|---|---|---|---|
| WO | WO 2010/103275 | A1 | 9/2010 |
| WO | WO 2014/022611 | A1 | 2/2014 |
| WO | WO 2014/124533 | A1 | 8/2014 |
| WO | WO 2014/158333 | A1 | 10/2014 |
| WO | WO 2015/049125 | A2 | 4/2015 |
| WO | WO 2015/119634 | A2 | 8/2015 |

OTHER PUBLICATIONS

Ayasse, "Fracture-Flooding," Generic Presentation, May 2015, IOR Canada Ltd., Calgary, Alberta, Canada.

International Search Report in related International Application No. PCT/NO2016/050256, dated Sep. 5, 2016.

* cited by examiner

SYSTEM AND METHOD FOR ENHANCED OIL RECOVERY

BACKGROUND

Field of the Invention

The present invention relates to oil production, and more specifically, to a system and method for enhanced oil recovery.

Related Art

As the term is used herein, a "well" is a structure extending vertically into the ground through a geological formation comprising several layers of rock, and may comprise one or more lateral branches extending into layer(s) of porous reservoir rock containing hydrocarbons. The well may be onshore or offshore, and comprises a wellhead at a surface. The wellhead is connected to other equipment, e.g. a "Christmas" tree for connecting one or more pipes for production and/or injection. However, for purposes of this disclosure, the upper end of the well is the wellhead, which comprises equipment for containing the pressure within the well. A surface casing extends from the wellhead into the ground, and is cemented to the formation.

A "vertical" part of the well may deviate more or less from the vertical. Similarly, lateral branches following a reservoir rock layer are not necessarily horizontal, and they are not connected to vertical parts of the well at right angles. Thus, different sections of the well may have any inclination between vertical and horizontal. In addition, the "downstream" direction is away from the surface during injection, and toward the surface during production. For ease of explanation, the terms "uphole" and "downhole" are used in the present Application. Uphole is the direction toward the surface, regardless of whether an interval of the well is vertical, inclined or horizontal, and regardless of the flow direction. Similarly, downhole means the opposite direction, i.e., away from the surface. Thus, while "downhole" may mean only "within the well" in other contexts, both uphole and downhole are directions within the well in the present Application.

The present invention relates to any completion. For example, the well may have cased and uncased sections in any combination. Some wells may have a production tubing extending to the bottom of the well, while other wells may convey fluid through a casing to the wellhead. Sand screens may be used in some types of rock, whereas predrilled tubing may be used in harder rock types. The skilled person is familiar with these and other completion techniques, as well as with their advantages, shortcomings and use in different applications. Thus, completion techniques and associated equipment need no detailed description herein.

Both production wells and injection wells are designed in the manner briefly described above. Indeed, depleted production wells become injection wells on many oil or gas fields. Furthermore, a well may be stimulated, for example by hydraulic fracturing, several times during its lifetime.

A "string section", as the term is used herein, is a section of tubing capable of conveying fluid in one or more conduits, e.g., concentric pipes or a sectioned pipe. However, in preferred embodiments, the string section comprises standard pipes connected by threaded pins and boxes, as this facilitates inclusion of other elements such as packers and valves in the string section by means of similar threaded pins and boxes.

As used herein, a "packer" is a generic element configured to seal the annulus between a string section and the surrounding casing or rock face, and may comprise one or more physical packers. A physical packer typically comprises an expandable, swellable and/or inflatable elastic element designed for a particular application, e.g., a steel casing or a rock face of a certain type. An increased pressure rating means an increased ability to withstand a pressure across the packer, and thus a more powerful design or an increased number of less expensive elements or physical packers. Either way, the generic packers described herein become more expensive with an increased pressure rating. Packers as such are commercially available, and need no further detailed description for the purposes of the present invention.

The recovery of a hydrocarbon mixture derived from petroleum fluids initially filling the pore volumes of a reservoir rock can be enhanced by injection of extraneous fluids or "injectants" such as water, hydrocarbon gas, non-hydrocarbon gas (e.g., $CO_2$ and $N_2$), chemicals, or combinations of these injectants. These methods are known as Enhanced Oil Recovery (EOR). Somewhat simplified, EOR aims to urge a formation fluid toward a production well. Thus, EOR requires fluid communication, e.g., a porous layer of reservoir rock, between the injection site and the production site.

The "recovery enhancement" is defined as the extra oil recovered beyond that which would be recovered if reservoir fluids are produced by natural depletion in the absence of extraneous injectants, i.e., by pressure depletion and natural water influx. Enhanced oil recovery results from a number of physical processes by which the injectant interacts with in situ hydrocarbon fluids in the reservoir volume which encounter the injectant. Immiscible displacement is controlled by viscosity, relative permeability and gravity effects. Miscible displacement is controlled by thermodynamic phase equilibrium that recovers essentially all in situ oil in the swept volume. Processes that reduce the ability of interfacial rock-fluid forces to retain liquid hydrocarbons are also used, and sometimes a combination of these recovery mechanisms are used in EOR.

Typical oil recoveries by natural depletion range from 5% to 30%, with enhanced oil recovery methods resulting in ultimate recoveries that can reach 50-70% of the initial oil in place. The magnitude of reservoir rock permeability (ability to flow fluids within a rock) in conventional reservoirs ($>10^{-3}$ darcy) will have little effect on the depletion oil recovery, as is documented in practically all books on reservoir engineering. However, for sufficiently low permeability reservoirs, the expected oil recovery by natural depletion decreases with decreasing permeability. For shale (or any ultra-tight reservoirs with permeability $<10^{-6}$ darcy), the expected depletion oil recovery is in the range of 5%, whereas EOR methods may yield a tenfold increase in ultimate oil recovery.

Conventional EOR makes use of dedicated injection wells used to place injectant into the reservoir, and dedicated production wells with their entire wellbores used to produce oil from the reservoir. Conventional EOR methods can be categorized into two types:

(1) Multi-well EOR with dedicated wells used to place injectant into the reservoir, and separate dedicated production wells used to produce from the reservoir from the entire wellbore; and (2) Single-well EOR using one well with its entire wellbore placing injectant into the reservoir for a period of time, followed by a period of time when the same well produces from the reservoir throughout the entire wellbore. This EOR method is usually referred to as "huff-and-puff", and is distinguished by many cycles of injection and production. Huff-and-puff EOR is not considered an efficient EOR process because it does not displace hydrocarbons in the direction from an injection point toward a production point.

The conventional multi-well EOR method is by far the most common, and the most effective at achieving high levels of oil recovery enhancement.

As used herein, a "completion interval" is any section along the wellbore that is in direct contact with the reservoir. So-called lower well completions connect the reservoir to the wellbore and a tubular string within the wellbore. Lower completions include:

(1) perforated casing, in which directed explosive charges are used to perforate the steel casing and surrounding cement separating the wellbore from the reservoir, and (2) open hole, i.e., not introducing obstructions such as cemented casing to separate the wellbore from the reservoir.

Completion frequently involves stimulation, i.e., treating one or more completion intervals in order to enhance fluid flow into or out of the formation. Any completion interval may be stimulated, including intervals with perforated casing and open hole intervals. One example of stimulation is hydraulic fracturing, in which high pressure liquid creates fractures in the rock, and "proppants" such as sand or ceramic beads enter the fractures. When the fracturing pressure is relieved, the proppant remains in the fractures to keep them open. Other types of stimulation known in the art include injection of water with acid, salts, surfactants or other additives. Stimulation may be performed simultaneously for the entire well or selectively within a completion interval. The well or completion interval(s) may be stimulated, e.g., by hydraulic fracturing, several times during its lifetime.

An isolated completion interval, hereinafter "segment" for short, is separated from an adjacent completion interval by one or more packers.

Conventional enhanced oil recovery methods are designed to use all completion intervals within a single wellbore for (1) production only, (2) injection only, or (3) periodic cycles of dedicated production or dedicated injection.

However, conventional EOR technology is excessively expensive in some cases, e.g., in ultra-tight reservoirs such as shale, and for smaller offshore oil fields where the reserves are too small to cover the cost of several wells. The excessive cost prevents an opportunity for substantial oil recovery.

For example, there are many thousands of horizontal multi-fractured wells located in major liquid-rich (oil and condensate) fields such as Bakken, Eagle Ford, and the Permian Basin, where current depletion recoveries are known to be low, and where conventional EOR is deemed to be too expensive.

Another example is offshore marginal oil fields where costs are critical and a minimum number of wells can be drilled, typically less than 4, which is far fewer than needed for traditional EOR methods.

Thus, for the examples above and perhaps others, there is a need for an inexpensive and efficient system and method for EOR. Accordingly, a first objective of the present invention is to provide a system and a method with decreased investment and operational costs compared to known EOR. A second objective is to provide such a system and method that decreases the required number of injection wells. Preferably, these objectives should be achieved while retaining the benefits of known EOR.

SUMMARY OF THE INVENTION

These and other objectives are achieved by a system and a method according to the appended claims.

In a first aspect, the invention concerns a system for enhanced oil recovery comprising a vertical and/or lateral string section configured for installation in a wellbore, a production segment with an uphole production packer and a production valve that allows a fluid flow into the string section and prevents a fluid flow in the reverse direction. The system also comprises an injection segment with an uphole injection packer and an injection valve that allows fluid flow out from the string section and prevents a fluid flow in the reverse direction. The system is distinguished in that the production segment and the injection segment are configured to be installed in fluid communication with each other through a reservoir within one well. Further, the production valve is configured to open when the pressure within the production segment is at or below an ambient pressure and to close when the pressure within the production segment exceeds the ambient pressure. The injection valve is configured to open when the pressure within the injection segment exceeds the ambient pressure and to close when the pressure within the injection segment is at or below the ambient pressure.

Here and in the claims, "a", "an" and "the" shall be construed as "(the) at least one", whereas "one" means exactly one. Thus, the system comprises one or more string sections that may form any angle with respect to the Earth's crust. Each such string section may comprise zero or more production segments. If present, each production segment has one or more uphole production packers and one or more production valves. Each string section may also comprise zero or more injection segments. If present, each injection segment has one or more uphole injection packers and one or more injection valves. While an individual string section may lack a production segment or an injection segment, the system requires at least one production segment and at least one injection segment.

The only constraints on the orientation of the valves regard the direction of fluid flow into or out of the string section. In particular, there are neither constraints regarding the location of a valve relative to its associated packer nor constraints regarding the axial or radial orientation of a valve relative to its associated string section.

The features described so far applies to any system for enhanced oil recovery (EOR), including systems with dedicated injection wells separate from one or more dedicated production wells. Thus, any equipment, injectant or technique known from technical fields relating to EOR may be employed with the system according to the invention.

However, in operation, the production segment and the injection segment are installed in fluid communication with each other through a reservoir within one well, i.e., in a single vertical wellbore with zero or more lateral branches. The injection valve opens when the pressure within the injection segment containing the injection valve is greater than the ambient pressure, i.e., the pressure around the injection valve. This enables a flow of injectant from the injection segment into the formation. The packers prevent direct fluid flow through the wellbore, so the injectant displaces hydrocarbons toward the production segment through the reservoir as briefly discussed above. The production valve opens when the ambient pressure, i.e., the pressure around the pertinent production valve, is greater than the pressure within the production segment containing the production valve. This enables a flow of formation fluid into the production segment. It is understood that the ambient pressure, i.e., the pressure around an individual production or injection valve, is different around different valves at different locations in the well.

Summarized, the distinguishing features enable injection and production from separate and dedicated segments within a single well. Injection and production may take place at different times in a cyclic embodiment, or at different places in an embodiment with continuous injection and production. In the cyclic embodiment, injection and production valves may be configured within one string section such that a pressure increase in the string section allows injection into the formation through the injection segments, and a subsequent pressure decrease allows production of formation fluid through separate and dedicated production segments.

Some embodiments of the system further comprise a shut-off segment with an uphole shut-off packer and no open valve. Some shut-off segments may comprise no valve whatsoever. Other shut-off segments may be abandoned production or injection segments, and as such, comprise a valve. Still other shut-off segments may comprise an injection valve or a production valve for future use. However, if a valve is present in a shut-off segment, the valve is closed permanently, or at least during the injection and production cycle.

Each production, injection and/or shut-off segment may further comprise a corresponding downhole packer. The downhole packers are optional, as it is entirely possible to configure a segment without a downhole packer, e.g., at an end section of a vertical or lateral wellbore, or where an uphole packer in one segment doubles as the downhole packer of an uphole adjacent segment.

In some embodiments, the production valve and/or the injection valve may be axially oriented within the string section. In these embodiments, a single packer may isolate, for example, an entire lateral branch or the bottom section of the vertical wellbore, and the axial valve may control flow through radial openings in the isolated string section.

Another aspect of the present invention concerns a method for enhanced oil recovery comprising the steps of:

a) installing the system according to the claimed system within a single well comprising a vertical wellbore and zero or more lateral branches, b) injecting an injectant through the injection segment and producing a formation fluid through the production segment, c) deciding if production should stop, and d) terminating the production permanently.

The system described above is configured for installation in a single well, but it is not necessarily installed in the well. Thus, step a) is required for operation. Step b) includes continuous injection and production, e.g., by providing an inner tubing with injectant at an injection pressure and a return path for formation fluid in an annulus around the inner tubing. The decision in step c) may be based on any parameter, including content of hydrocarbons in the produced formation fluid. Step d) may include plugging and decommissioning of the well.

In some embodiments, injecting and producing in step b) is cyclic and involves the steps of:

b1) increasing the pressure within the string section, b2) injecting the injectant through the string section, b3) decreasing a pressure within the string section, and b4) producing the formation fluid through the string section.

In the cyclic embodiment, steps b1) through b4) are repeated until the decision to stop in step c) is made. The pressure within the string section is controlled from the surface, e.g., by increasing or decreasing a pump rate.

As noted, "the string section" shall be construed as "the at least one string section". Some string sections may comprise a single production segment. As the production valves close during injection, string sections with one production segment will be inactive during injection. Similarly, some string sections may comprise a single injection segment, and thus be inactive during production. Other string sections may comprise one or more production segments and one or more injection segments. In these string sections, only the injection segments will be active during injection and only the production segments will be active during the production part of the cycle.

Regardless of whether the injection and production is continuous or cyclic, the method may further comprise the steps of:

e) determining if the stop in step c) is temporary, and f) suspending and resuming production if the stop in step c) is temporary.

Steps e) and f) enable maintenance, including re-fracturing or re-stimulation, while the production is suspended. Steps e) and f) also enable batchwise applications, e.g., where product is shipped by a vessel and/or injectant is supplied by a vessel. Step e) is performed between the decision to stop in step c) and the permanent shutdown in step d). Step f) includes any monitoring and procedures required to resume production.

Further features and benefits will become apparent from the following detailed description of the preferred embodiments when taken with the figures.

BRIEF DESCRIPTION OF THE DRAWINGS

The invention will be explained in greater detail by means of examples with reference to the accompanying drawings, in which.

DETAILED DESCRIPTION OF PREFERRED EMBODIMENTS

The drawings are intended to illustrate the principles of the invention. Thus, they are not necessarily to scale, and numerous details known to those skilled in the art are omitted for clarity. This includes, for example, pumps, a wellhead with a Christmas tree and other facilities at the surface. As noted, the system and method according to the invention can be configured for cyclic or continuous injection and production.

Figure 1:
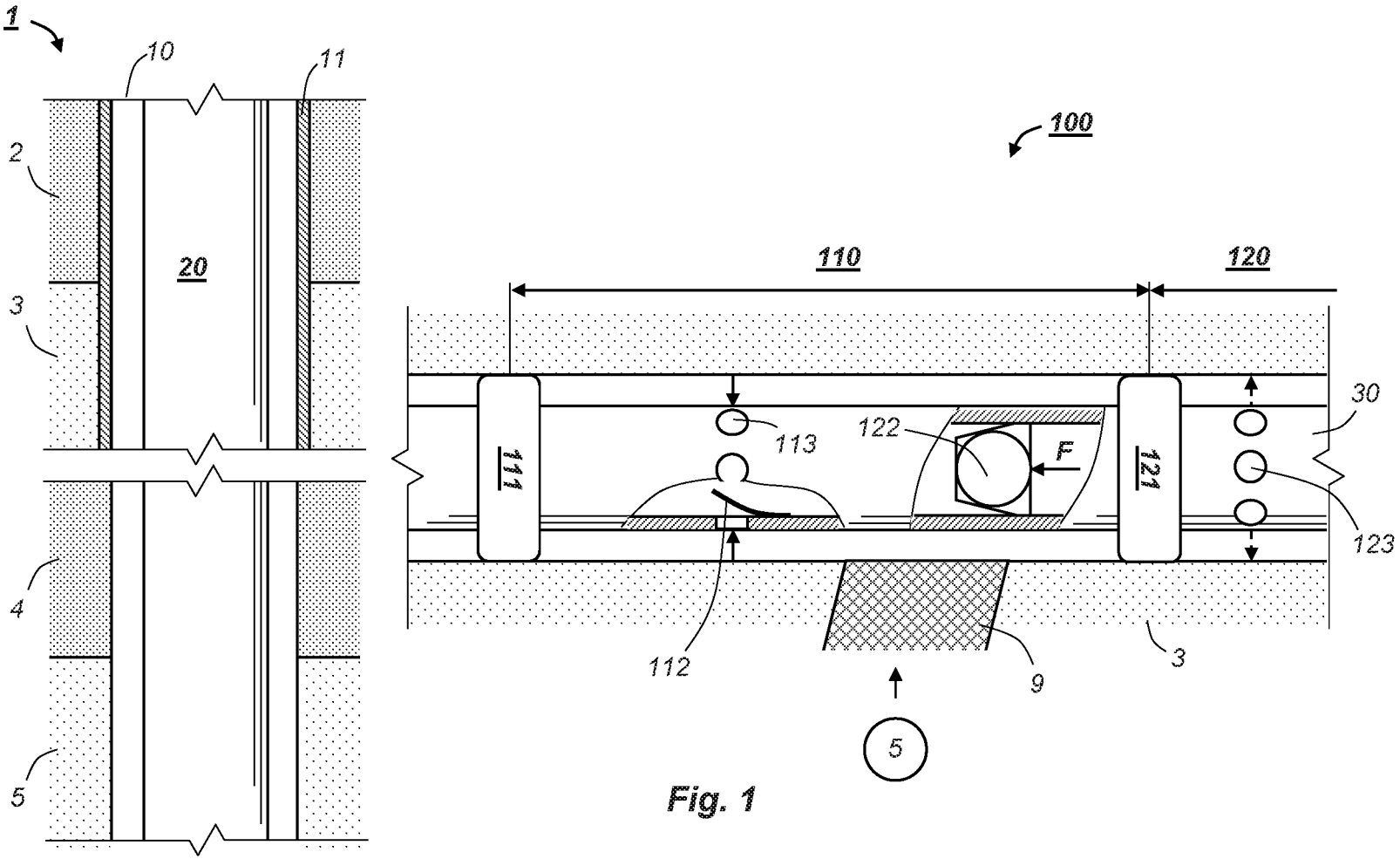
FIG. 1 illustrates physical elements in a system according to the invention.

Specifically, FIG. 1 illustrates a cyclic embodiment of a system 100 in a production mode. An injection mode of the cyclic embodiment as well as the continuous embodiment will be further described with reference to FIG. 2.

FIG. 1 shows a system 100 installed in a formation 1, which comprises several rock layers 2-5 and may be located under dry land or under a seafloor. Layers 3 and 5 are reservoir rock layers, i.e., layers of porous rock containing hydrocarbons. Layers 2 and 4 immediately above the reservoir layers 3 and 5, respectively, are impermeable to hydrocarbons. However, a fracture 9 illustrates a fluid connection between the reservoir layers 3 and 5, i.e., through the layer of impermeable rock 4. Such a fracture 9 may be, for example, a natural fault or cracks caused by hydraulic fracturing.

A generic well comprises a wellbore 10 extending vertically through the formation 1 and zero or more lateral branches or boreholes, one of which is shown in FIG. 1. The wellbore 10 has a casing 11 along part of its length, as illustrated at layers 2 and 3, and no casing along other parts, as illustrated at layers 4 and 5. The casing 11 may be cemented to the formation 1, and may be penetrated by explosive charges at one or more reservoir layers (not shown). A real well may comprise any combination of cased and uncased completion intervals forming any angle with the Earth's crust, i.e., any angle between vertical and horizontal.

The well may be stimulated by hydraulic fracturing, injection of acid, surfactants or other chemicals as briefly discussed above.

A string section 20 is inserted into the vertical wellbore 10, and runs vertically through layers 2-5. In the cyclic embodiment, the string section 20 within wellbore 10 is optional, because fluids may flow within casing 11 without any string section 20. An embodiment with continuous injection requires separate conduits for injection and production. For example, an injectant can be injected through string section 20 while a return path for formation fluid is provided by the annulus around the string section 20. Alternatively, the string section 20 may comprise an inner tubing. In all embodiments, some string, e.g., an extension of string section 20, must run from the wellhead to production and injection facilities at the surface, in particular to pumps or compressors for controlling pressure within the well.

The string section 20 and string sections 30, 40 and 50 described below may comprise pipes with standard threaded pins and boxes at their ends. Thereby, devices with similar threads, e.g., valves and packers, can be included in string sections 20, 30, 40 and 50 with standard threaded connections. This does not exclude other alternatives known in the art.

A string section 30 is inserted into a lateral uncased borehole within reservoir layer 3. The string section 30 has a fluid connection to the surface, such that injectant can flow from the surface through string section 30, and such that formation fluid can flow from reservoir layer 3 to the surface through the string section 30. The string section 30 can be a section of the string section 20. Alternatively, the string section 30 could be disconnected after run in, i.e., such that there is no mechanical connection between the lateral string section 30 and the vertical string section 20. A real embodiment may include a sand screen and other equipment known in the art.

An uphole production packer 111 and an uphole injection packer 121 isolate a production segment 110. In the production segment 110 in FIG. 1, the string section 30 comprises radial openings 113 with a production valve 112 oriented such that it permits fluid flow from the formation 3 to the interior of the string section 30, and blocks flow in the reverse direction, i.e., from the interior of the string section 30 to the formation 3. The production valve 112 is a radially oriented check valve of any suitable type, e.g., with a hinged or elastic flap as shown in FIG. 1.

The uphole injection packer 121 isolates an injection segment 120 downhole from the production segment 110. In the injection segment 120, the string section 30 comprises radial openings 123 with an injection valve 122 oriented such that it permits fluid flow from the interior of the string section 30 to the formation 3, and blocks flow in the reverse direction, i.e., from the formation 3 to the interior of the string section 30. The illustrated injection valve 122 is an axially oriented check valve of any suitable type, e.g., a biased ball in a frustoconical seat as shown in FIG. 1.

The valves 112 and 122 in FIG. 1 illustrate two principles used in many check valves, i.e., a flap and a biased ball, respectively. Alternatively, the production valve 112 and the injection valve 122 might be of the same or similar design, but oriented in opposite directions. This would have the benefits of simplified manufacture and larger series, as only the orientation of the installed check valves 112, 122 would determine whether the segment 110, 120 injects into the reservoir or produces from the reservoir.

In some embodiments, all or some of the check (one way) valves 112 and 122 described above may be replaced with other valve types, as long as the replacement valve ensures fluid flow one way into a production segment 110, but not in the reverse direction, and one way out of an injection segment 120, but not in the reverse direction. For example, a long open hole completion may provide varying flow rates along its length depending on the permeability of the surrounding rock. It may be desirable to ensure uniform inflow into the production string, and hence, to install valves with feedback to keep the flowrate within set limits. In principle, such feedback might be provided by any means, e.g., a feedback loop with a sensor, an electronic control unit and an actuator. However, a robust and relatively simple design would be preferred within a wellbore. For example, the valve may be designed such that an increased flowrate increases a backpressure, which in turn restricts a passage to decrease the flowrate, and vice versa. Valves with similar feedback mechanisms adapted for production and injection are commercially available as inflow control devices (ICDs) and injection ICDs, respectively. However, an ICD or other valve with feedback is usually more expensive than a check valve due to its more complex design. Some feedback valves also require additional equipment, for example, a sand screen adapted to the selected valve or a protective housing for electronics. Thus, a simple one-way valve would be preferred in many applications.

In the production mode illustrated in FIG. 1, the production valve 112 is open, and the injection valve 122 is closed. Thus, formation fluid flows into the string section 30 within the production segment 110, but not into the injection segment 120. After a period in the production mode, a pump at the surface increases the pressure within string section 30 until the injection valve 122 opens. This pressure also closes the production valve 112, and the system 100 enters an injection mode (not shown). In the example shown in FIG. 1, the injection valve 122 opens when the pressure working on an exposed part of the ball overcomes a biasing force F. At the injection pressure, the flap in the production valve 112 covers the opening 113. Thus, in the injection mode, injectant is urged into the formation 3 from the injection segment 120, but not from the production segment 110.

As shown in FIG. 1, the injection valve 122 may be located uphole from its associated injection packer 121. The axially oriented injection valve 122 might equally well be located downhole from the uphole injection packer 121. In the example of FIG. 1, the injectant will flow though the injection openings 123 as long as the injection packer 121 and the axial injection valve 122 are included between the production openings 113 and the injection openings 123. Similar requirements apply to the production segment 110 and to string sections with axial valves in general.

Thus, formation fluid may flow to the surface through the production segment 110 during a production period, and injection fluid may be pumped from the surface through the injection segment 120 during a subsequent injection period. The technical effect is that known techniques for EOR with separate injection and production sites can be performed within a single well. This saves time and costs associated with separate dedicated injection and production wells without reverting to the "huff-and-puff" method described above, and may make enhanced production from previously abandoned wells and marginal fields viable.

The fracture 9 provides a fluid path from reservoir layer 5 to the reservoir layer 3. Thus, injection in layer 5 may enhance production through the production segment 110 in layer 3. While a fluid connection through the reservoir is required between an injection segment 120 and a production segment 110, the fluid connection need not be located within a single reservoir layer, e.g., only in layer 3.

Figure 2:
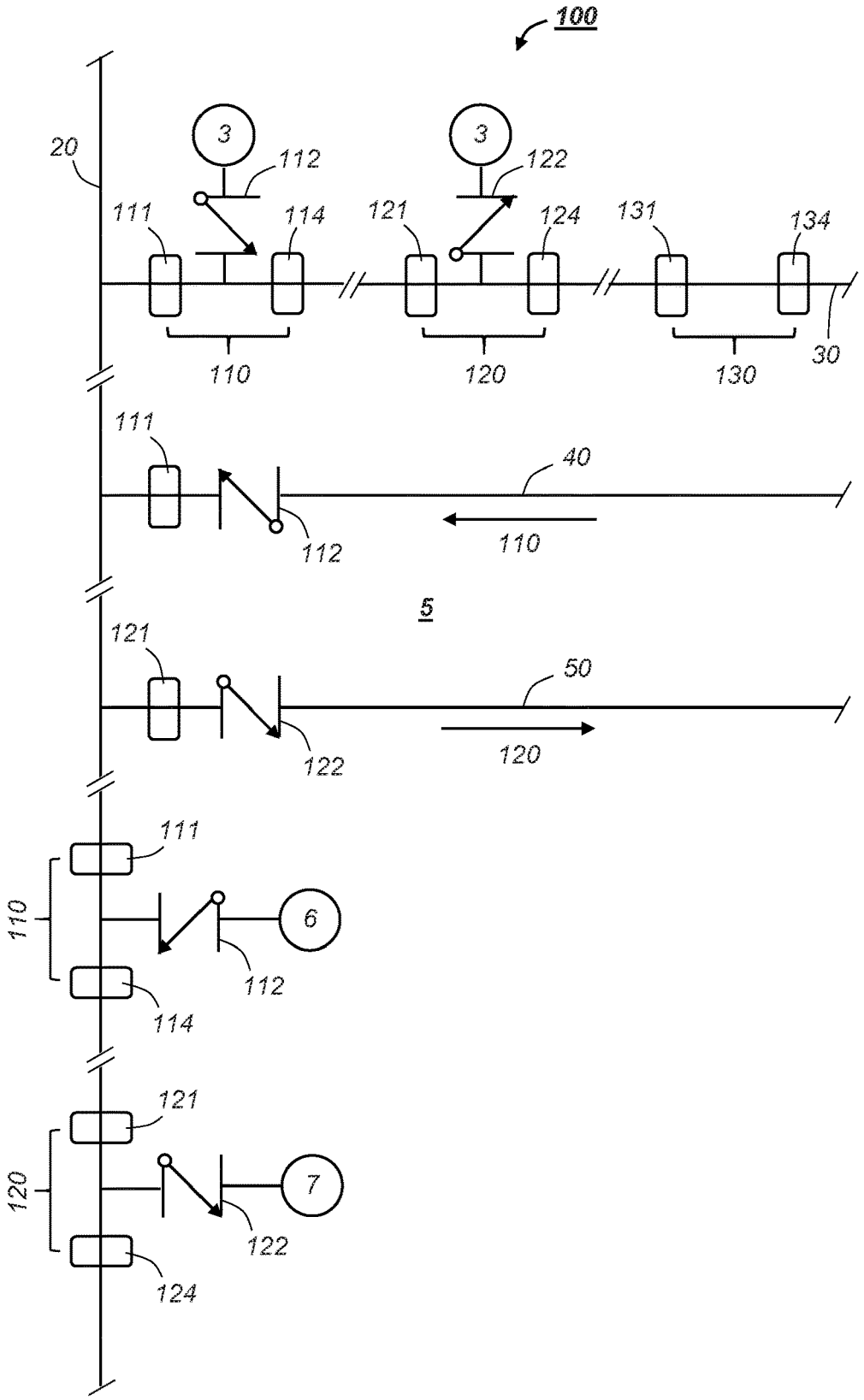
FIG. 2 is a schematic diagram illustrating the system according to the invention.

FIG. 2 is a schematic diagram illustrating various configurations encompassed by the system 100 of the invention. The production segment 110, production packer 111 and the radially oriented production valve 112 between the reservoir layer 3 and the string section 30 are similar to the corresponding elements described with reference to FIG. 1. However, in FIG. 2, a downhole production packer 114 delimits the production segment 110, whereas in FIG. 1, an adjacent uphole injection packer 121 doubles as the downhole packer for segment 110.

The injection segment 120 in string section 30 of FIG. 2 differs from the one shown in FIG. 1 in that the injection valve 122 is radially oriented rather than axially oriented with respect to the string section 30. The uphole injection packer 121 and a downhole injection packer 124 isolate the injection segment 120. Thereby, packers with a lower pressure rating, i.e., less expensive packers, may be used in other parts of the system 100. For example, packers 111, 114, 131 and 134 could have a lower pressure rating than the injection packers 121, 124.

A shut-off segment 130 is isolated by an uphole shut-off packer 131 and a downhole shut-off packer 134 sealing the annulus between string section 30 and the wellbore, e.g., a casing in a cased completion interval or a rock face in an open hole completion interval. The shut-off segment 130 has neither an open production valve nor an open injection valve. However, the shut-off segment 130 may be a former production segment with its valves permanently closed due to water penetration or a former injection segment with its valves permanently closed due to excessive loss to formation. Such former production or injection segments have valves formerly used for flow control. In another example, the shut-off segment 130 was installed with valves for future use, such that it becomes an injection segment 120 or production segment 110 once its valve(s) is/are activated to open and close during an injection and production cycle. In both examples, any injection and production valves in a shut-down segment 130 are closed, at least during an injection and production cycle. Hence, the claims specify "no open valve" rather than "no valve". Configuring a shut-off segment 130 is known in the industry, and needs no further explanation herein.

A second production segment 110 is formed by a lateral string section 40, e.g., inserted into an uncased borehole within a reservoir layer 5. An uphole production packer 111 and a production valve 112 oriented axially within string section 40 are located near the vertical part of the well, i.e., at the entrance to the wellbore extending laterally into the reservoir layer. The string section 40 typically comprises radial holes through its cylindrical wall. While an axially oriented production valve 112 controls the fluid flow within the string section 40, the formation fluid may of course flow radially from the formation through such radial holes. Alternatively, the string section 40 may be provided with an axial hole rather than radial holes. The string section 40 may also comprise a sand screen and other equipment (not shown).

A string section 50 similar to string section 40 is inserted into another borehole and forms a second injection segment 120, for instance within the same reservoir layer 5 as the string section 40. The string section 50 is isolated from the vertical part of the well with an uphole injection packer 121, and includes an axially oriented injection valve 122. In the schematic diagram of FIG. 2, the lateral string section 50 appears below the lateral string section 40. However, in a real embodiment, the injecting section 50 may be located anywhere relative to the producing section 40, e.g., such that the string section 50 runs parallel to and some distance apart from the string segment 40 within a thin reservoir layer 5.

A third production valve 112 defines a third production segment 110 in direct fluid communication with a reservoir layer 6. The third production segment 110 is isolated by an uphole production packer 111 and a downhole production packer 114 in a vertical string section 20 rather than the lateral string section 30, and is otherwise of the same type as the first production segment at the top of FIG. 2. For clarity, it is noted that the production valve 112 controlling fluid flow from layer 6 illustrates a radial check valve included in a string section 20, not an axially oriented valve in a short, e.g., 1 meter long, lateral string section. This also applies to the injection and production valves in string section 30 above, and to the valve injecting to layer 7 described below.

Similar to the third production segment 110 in fluid connection with layer 6, a third injection valve 122 in the form of a radial check valve in string section 20 forms a third injection segment 120. An uphole injection packer 121 and a downhole injection packer 124 isolate the third injection segment 120, which is configured to inject fluid into a layer 7, and is otherwise similar to the first injection segment 120 at the top of FIG. 2.

Thus, in FIG. 2, the first and third production segments 110 are similar, but have different inclinations, shown as horizontal along string section 30 and vertical along string section 20, respectively. The first and third injection segments 120 are also similar, but have different inclinations. The second production and injection segments differ in that axial valves 112 and 122 are included in the lateral strings 40 and 50, respectively. Thus, one packer 111, 121 isolate each of the lateral strings 40 and 50, while a pair of packers isolates each first and third production and injection segment. Obviously, a bottom part of string section 20 could be configured in the same manner as the string sections 40 or 50, i.e., with a packer isolating the bottom section and an axially oriented check valve. In this case, the axial check valve could be a production valve or injection valve, depending on the application.

The number and configuration of segments in a real embodiment will most likely differ from the schematic diagram shown in FIG. 2. In general, the system 100 may comprise any number, combination and inclination of production segments 110, injection segments 120 and shut-off segments 130 described above, as long as there is fluid communication through the reservoir between an injection segment 120 and a production segment 110. The fluid communication may be provided within one layer of reservoir rock, e.g., as illustrated by string section 30 within layer 3 and string sections 40 and 50 within layer 5. Alternatively, the required fluid communication may be provided through a fracture, as illustrated by fracture 9 in FIG. 1.

So far, a cyclic embodiment of the system 100 has been described. In an alternative embodiment for continuous injection and production, the system 100 cannot comprise active injection valves and production valves within a single string section. Thus, while the string sections 40 and 50 illustrated in FIG. 2 might be implemented in the embodiment with continuous injection and production, the string sections 20 and 30 would not be installed, as they comprise production valves 112 and injection valves 122 in the same string section.

As mentioned above, embodiments with continuous injection require an injection string, and may provide a return path in an annulus around the injection string. This may seem similar to ordinary circulation, e.g., during drilling where drilling fluid is pumped down a drill string and returns to the surface through the annulus around the drill string. However, all embodiments of the present invention require at least one production valve 112 in fluid communication with at least one injection valve 122 within the same well, and thereby differ from the known circulation applications. Configuring an embodiment of the system 100 for continuous injection and production is considered within the capabilities of the skilled person.

In all embodiments of the system 100, the production valve(s) 112 are open when the pressure within the production segment is lower than the ambient pressure, i.e., the pressure around the particular production valve. The ambient pressure may be different for different production valves 112, e.g., located in different lateral boreholes. Similarly, the injection pressure required to open the injection valve(s) 122 is relative to the ambient pressure, which may be different at different injection valves 122. The pressure within the string sections is controlled by adjusting a pump rate at the surface, and is relative to the pressure around a valve. In other words, the absolute pressures at the different valves are less important.

In the production mode, the pressure within the string sections 20, 30, 40 comprising a production valve 112 is lower than the pressure in the surrounding wellbore, such that formation fluid flows from the formation into the production segments 110. Only the production segments 110, i.e., the segments with production valves 112, will yield reservoir fluids into the string sections 20, 30 and 40, and further to the surface. The injection segments 120 and shut-off segments 130 will be closed for influx from the formation.

In the injection mode, the pressure within the string sections 20, 30, 50 comprising an injection valve 122 is greater than the pressure in the surrounding wellbore, such that injectant flows out from string sections 20, 30 or 50 into the formation 1. In the injection mode, only the injection segments 120, i.e., those completion intervals with injection valves 122, will allow injectant to enter the reservoir. The other completion intervals, i.e., the production segments 110 and shut-off segments 130, will be closed for fluid flow toward the formation 1.

In a system 100 configured for continuous operation, injectant will only exit through the injection segment(s) 120, and formation fluid will only flow through separate production segments 110 in the same well.

Injection, production and flow control as such are known in the field relating to EOR, and outside the scope of the present invention. In other words, the present invention regards employing these known techniques in a single well. In general, the actual design of system 100 depends on many factors, and must be left to the skilled person knowing the application at hand.

Figure 3:
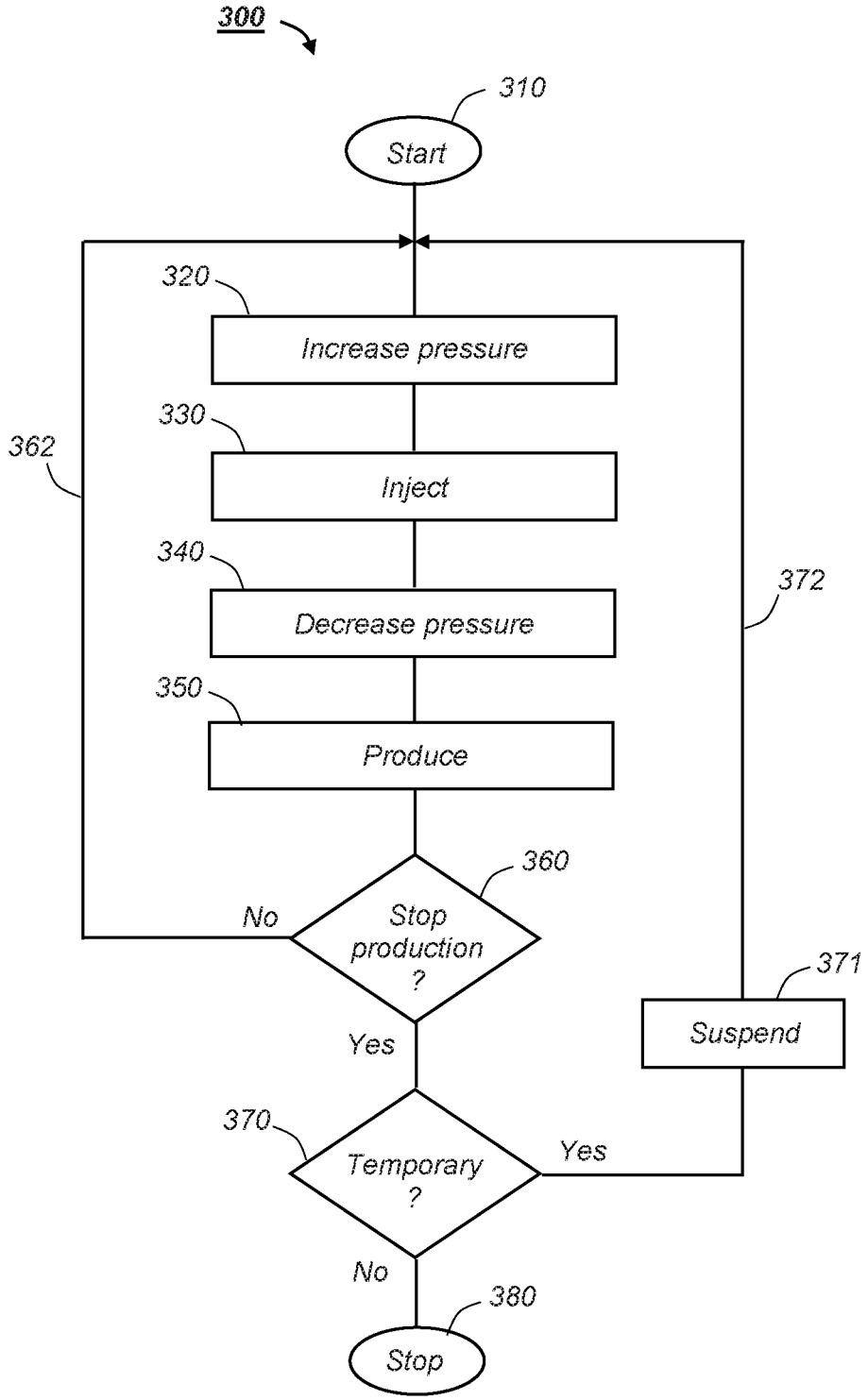
FIG. 3 is a flow diagram illustrating the method of the invention.

FIG. 3 illustrates the method of EOR according to the invention. More particularly, the flow diagram in FIG. 3 includes a cycle with alternating injection and production modes, and an option for temporary halts in the injection and production. The cyclic embodiment of the present invention is discussed below.

The method starts in step 310, where the system 100 described above is adapted, installed and prepared for operation, for example, in a pre-existing wellbore.

In step 320, the pressure is increased in production segments 110 as well as in injection segments 120, e.g., by means of pumps or compressors at the surface. The pressure increase opens the injection valve(s) 122 and closes the production valve(s) 112. Thus, the production segments 110 become inactive and the injection segments 120 become active, such that fluid can be injected into the reservoir adjacent the injection segment(s) 120.

In step 330, the injection mode, an injectant is urged into the reservoir. The injectant may be any suitable chemical known in the art, including $CO_2$, $N_2$, water with or without additives, etc., as briefly discussed above. This step includes any monitoring and control required during injection into the well.

Step 340 involves decreasing the pressure in production segments 110 as well as in injection segments 120 to below the respective ambient pressures, e.g., below the pressure at the rock face of the reservoir around the respective string sections. This opens the production valve(s) 112 in the production segment(s) 110 and permits a flow of formation fluid from the reservoir into the respective string section 20, 30, 40. The decreased pressure also closes the injection valves 122, thereby preventing fluid flow into the injection segment(s) 120.

Step 350, the production mode, includes all actions required to operate a production well, including monitoring and controlling the well.

In step 360, it is decided whether production should be stopped or continued. The decision may be based on any known parameter. For example, production may terminate at a predetermined point in time, when the water cut becomes too high, etc., as known in the industry.

If the decision in step 360 is to continue production, the method loops back at 362 to step 320, in which the pressure is increased in production segments 110 and injection segments 120, for a new injection mode and a subsequent production mode.

The embodiment with continuous injection does not implement the steps of increasing and decreasing pressure, i.e., steps 320 and 340, at different times. Instead, this embodiment increases the pressure in injection segments 120 at different locations than the production segments 110 in the well. Thus, the loop or cycle 362 in FIG. 3 is optional.

If a decision to stop is made in step 360, the method of FIG. 3 proceeds to step 370 to determine whether the stop is permanent or not. If the stop is temporary, operation is suspended at 371 and then returns at 372 to normal operation.

A temporary halt 371, 372 in production permits maintenance, including re-fracturing some or all segments in the well. The temporary halt 371, 372 also permits batchwise operation. For example, storage facilities may be limited, such that a vessel is required to remove produced hydrocarbon before continuing normal operation. Alternatively, the injectant may be supplied batchwise. For example, captured $CO_2$ might be supplied by a vessel in batches, and be injected for permanent storage in combination with the EOR described above.

Step 371 includes any procedures required for resuming operation, e.g., procedures for receiving a command to restart injection 330 and (subsequent) production 350, and procedures for executing such a command.

In theory, the system 100 may be designed for uninterrupted operation, e.g., by allowing maintenance in some parts of the well, while injecting and producing continues in other parts. Such uninterrupted operation may incur additional costs. Hence, whether such a design is viable depends only on the application at hand. Accordingly, the suspension loop 371, 372 in FIG. 3 is optional.

If the decision in step 370 is that operations should stop permanently, the method proceeds to step 380, which includes any procedures required to permanently shut down and possibly decommission the well.

In all embodiments of the method 300, the fluid injected through the injection segments displace hydrocarbons towards the production segments in the same way as in conventional EOR using one or more dedicated production and injection wells. This ensures the same high recovery efficiency as a conventional multi-well EOR process, but requires only a single well. This is not the case for conventional single-well huff-and-puff EOR, where recovery efficiency is relatively low, and the rate of recovery is often slow.

With a long (e.g., 1.5 to 3 km) wellbore, with 5 to 50 or more segments, substantial EOR potential exists from a single well. Each well in a field becomes its own "isolated EOR project" using the system and method according to the present invention.

The proposed EOR method can readily be used with all of the many thousands of horizontal multi-fractured wells located in major liquid-rich (oil and condensate) fields such as Bakken, Eagle Ford, and the Permian Basin, where current depletion recoveries are known to be low.

A second potential application is in offshore marginal oil fields where costs are critical and a minimum number of wells can be drilled (typically <4), far fewer than needed for traditional EOR methods. Using the proposed method, one can convert each physical wellbore into both injection and production wells, thereby providing the potential for higher EOR results.

The proposed method also provides a solution for continuous re-injection of produced gas (and water) required by marginal oil field developments using floating production-storage (FPSO) systems.

While the invention has been explained by means of examples, the scope of the invention is set forth in the following claims.

The invention claimed is:

1. A system for enhanced oil recovery comprising:

at least one of, a vertical and a lateral string section configured for installation in a wellbore;

a production segment including an uphole production packer and a production valve that allows fluid to flow into the string section and prevents fluid from flowing in the reverse direction;

an injection segment with an uphole injection packer and an injection valve that allows a fluid flow out from the string section and prevents a fluid flow in the reverse direction;

wherein the production segment and the injection segment are configured to be installed in fluid communication with each other through a reservoir within one well;

the production valve being configured to open when the pressure within the production segment is at or below an ambient pressure and to close when the pressure within the production segment exceeds the ambient pressure;

the injection valve being configured to open when the pressure within the injection segment exceeds the ambient pressure and to close when the pressure within the injection segment is at or below the ambient pressure; and a shut-off segment with an uphole shut-off packer and no open valve.

2. The system according to claim 1, wherein the production segment further comprises a downhole production packer.

3. The system according to claim 2, wherein the injection segment further comprises a downhole injection packer.

4. The system according to claim 2, wherein the shut-off segment further comprises a downhole shut-off packer.

5. The system according to claim 1, wherein the injection segment further comprises a downhole injection packer.

6. The system according to claim 5, wherein the shut-off segment further comprises a downhole shut-off packer.

7. The system according to 1, wherein the shut-off segment further comprises a downhole shut-off packer.

8. The system according to claim 1, wherein the production valve is axially oriented within the string section.

9. The system according to claim 1, wherein the injection valve is axially oriented within the string section.

10. A system for enhanced oil recovery comprising:

at least one of, a vertical and a lateral string section configured for installation in a wellbore;

a production segment including an uphole production packer and a production valve that allows fluid to flow into the string section and prevents fluid from flowing in the reverse direction;

an injection segment with an uphole injection packer and an injection valve that allows a fluid flow out from the string section and prevents a fluid flow in the reverse direction;

wherein the production segment and the injection segment are configured to be installed in fluid communication with each other through a reservoir within one well;

the production valve is configured to open when the pressure within the production segment is at or below an ambient pressure and to close when the pressure within the production segment exceeds the ambient pressure;

the injection valve being configured to open when the pressure within the injection segment exceeds the ambient pressure and to close when the pressure within the injection segment is at or below the ambient pressure;

a shut-off segment with an uphole shut-off packer and no open valve;

wherein the production segment further comprises a downhole production packer;

wherein the injection segment further comprises a downhole injection packer;

wherein the shut-off segment further comprises a downhole shut-off packer;

wherein the production valve is axially oriented within the string section; and wherein the injection valve is axially oriented within the string section.

11. A method for enhanced oil recovery, comprising:

installing a system within a single well including a vertical wellbore, installing at least one of, a vertical and a lateral string section in a wellbore, allowing fluid to flow into the string section and preventing fluid from flowing in the reverse direction by way of a production segment including an uphole production packer and a production valve, allowing a fluid flow out from the string section and preventing a fluid flow in the reverse direction by way of an injection segment with an uphole injection packer and an injection valve, installing the production segment and the injection segment in fluid communication with each other through a reservoir within one well;

opening the production valve when the pressure within the production segment is at or below an ambient pressure and closing it when the pressure within the production segment exceeds the ambient pressure;

opening the injection valve when the pressure within the injection segment exceeds the ambient pressure and closing it when the pressure within the injection segment is at or below the ambient pressure;

injecting an injectant through the injection segment and producing a formation fluid through the production segment;

stopping production of the formation fluid; and further comprising a shut-off segment with an uphole shut-off packer and no open valve.

12. The method according to claim 11, wherein the injecting and producing is cyclic and comprises:

increasing the pressure within the string section;

injecting the injectant through the string section;

decreasing a pressure within the string section; and producing the formation fluid through the string section.

13. The method according to claim 11, further comprising a) determining if the stopping is temporary; and b) suspending and resuming production if the stopping is temporary.

14. The method according to claim 11, wherein the system is installed within a single well including a vertical wellbore and at least one lateral branch.

* * * * *